United States Patent [19]

Pearcey et al.

[11] Patent Number: 4,488,392

[45] Date of Patent: Dec. 18, 1984

[54] UNDERGROUND HOUSE AND CONSTRUCTION METHOD

[76] Inventors: Dale A. Pearcey, 3730 S. Mill Ave., Tempe, Ariz. 85282; L. Gene Pearcey, P.O. Box 3270, Durango, Colo. 81301

[21] Appl. No.: 432,263

[22] Filed: Oct. 1, 1982

Related U.S. Application Data

[63] Continuation-in-part of Ser. No. 130,559, Mar. 14, 1980. Pat. No. 4,352,260.

[51] Int. Cl.[3] ..... E04G 21/00

[52] U.S. Cl. ..... 52/742; 52/80; 52/169.6; 264/32

[58] Field of Search ..... 52/80, 2, 169.6, 742, 52/82; 264/32, 34, 36

[56] References Cited

U.S. PATENT DOCUMENTS

| | | | |
|---|---|---|---|
| 2,365,145 | 12/1944 | Neff | 52/80 |
| 2,413,243 | 12/1946 | Neff | 52/80 |
| 4,144,680 | 3/1979 | Kelly | 52/82 |

*Primary Examiner*—Henry E. Raduazo

*Attorney, Agent, or Firm*—Cahill, Sutton & Thomas

[57] ABSTRACT

An underground house includes a dome-shaped structure disposed on a solid floor slab. A plurality of curved arch members extend from the floor slab to a ring structure. A layer of stiff mesh supporting a layer of fabric extends between each arch member and the arch members adjacent thereto. Alternate layers of spaced horizontal and vertical reinforcing rod extend over and generally parallel to the fabric and are supported by the various arch members. The various pieces of reinforcing rod are tied together and to the adjacent mesh by pieces of tie wire to support the mesh and the fabric. The fabric provides support during construction for a layer of gunnite or shotcrete into which various pieces of the reinforcing rod are embedded. Front and rear atriums with vertical, semi-cylindrical walls extend to the lower floor level. The atrium walls extend to adjoin the layer of gunnite to laterally enclose the atriums. Openings in the wall of the dome-shaped structure allow light in the atriums to enter the dome-shaped structure. A windowed cover is disposed over the ring structure to allow outside light to enter the dome. Earthen material covers the dome structure up to the base of the dome except portions bounded by the atrium walls, entry way cowls, and the windowed cover.

17 Claims, 25 Drawing Figures

UNDERGROUND HOUSE AND CONSTRUCTION METHOD

RELATED APPLICATIONS

This application is a continuation-in-part of our allowed pending patent application entitled "UNDERGROUND HOUSE AND CONSTRUCTION METHOD", Ser. No. 130,559, filed Mar. 14, 1980, which will issue as U.S. Pat. No. 4,352,260 on Oct. 5, 1982.

BACKGROUND OF THE INVENTION

1. Field of the Invention:

The invention relates to underground houses and methods of construction thereof and, more particularly, to dome-shaped underground houses and methods of construction thereof.

2. Description of the Prior Art:

With the advent of rapidly rising housing construction costs and heating and cooling costs, many different types of low-cost energy-efficient dwelling structures have been proposed. Underground or partially underground dwelling structures which have been proposed have certain advantages, a major advantage being that the temperature of the earth becomes more nearly constant as depth of the dwelling structure increases. Consequently, relatively uniform temperatures both in summer and winter have been obtained with previous underground or partially underground dwellings. However, in the past, it has been difficult and expensive to attain satisfactory lighting of the interior of known underground structures. Further, the costs of construction frequently have been unacceptably high compared to other low cost above-ground (but less energy efficient) dwelling structures.

Accordingly, it is an object of the invention to provide a low cost, energy-efficient dwelling structure and method of construction thereof providing substantially more natural interior lighting than has been available from previous underground or partially underground dwelling structures.

A variety of above-ground dome-shaped building structures have been proposed. However, they have required complex and unduly expensive welded steel frames. Expensive siding materials have been attached to the steel frames. Due to their high cost and the absence of any advantages related to energy efficiency, above-ground dome-shaped residential structures have not been popular.

None of the previously known above ground, underground or partially underground dome-shaped or "barrel-shaped" building structures have been both relatively low in cost and easily assembleable by untrained "do-it-yourselfers". For example, U.S. Pat. No. 2,365,145 discloses above-ground dome-shaped and barrel shaped structures constructed of preformed vertical arch members. The disclosed structure includes numerous horizontal channel members attached to the vertical arch members. Metal lathing is attached by wires to the inner surfaces of the vertical arch members to cover the interior surface of the erected structure, and plaster is ultimately applied to the metal lathing. On the outside of the grid formed by the vertical arch members and the horizontal channels attached thereto a blanket of insulation material disposed between sheets of paper is secured by tie wires to the vertical arch members. A layer of mesh is then applied over the blanket of insulation, and the exterior of the framework is shot with shotcrete. This structure and technique has numerous shortcomings. It would take a high degree of quality control and precision in providing accurately drilled bolt holes which would be properly aligned so that a "do-it-yourselfer" could make the many connections required between the vertical arch channels and the horizontal channels. The structure requires a very large number of both vertical arch channel members and horizontal channel members, as these are required to support the insulation layer without undue sagging when the wet shotcrete is sprayed on it. The large number of vertical arch supports and horizontal channel supports requires a very large number of bolt connections (or, if bolts are not used, then welded connections would be required and would greatly increase the cost.) The labor required for attaching the metal lathing to the interior of the vertical arch channels would be excessive, as would the cost of the metal lathing itself. Furthermore, this would provide very little support for the insulation, which subsequently is loaded with wet shotcrete. From a practical viewpoint, paperbacked fiberglass insulation or the like could not be used, because it would not adequately support the weight of subsequently applied wet gunnite or shotcrete without undue sagging. In fact, it is more than likely that shotcrete or gunnite sprayed at high pressure at the surface of the insulation would simply blow right through it.

Furthermore, even if the gunnite or shotcrete is applied in very thin layers which are each allowed to dry before a subsequent layer is sprayed thereon or otherwise allowed, the structure shown in U.S. Pat. No. 2,365,145 would be highly impractical for underground structures because unless waterproof, rigid insulation were used, there would be a great build up of condensation in the insulation layer, which would cause it to deteriorate and would also cause rusting and deterioration of the steel frame. Over a twenty or thirty year period, such rusting could dangerously weaken the structure.

U.S. Pat. No. 4,144,680 discloses an above-ground dome-shaped structure in which spaced vertical tubular arch members extend upward from a foundation. Pairs of clamped together tubular members are bolted to the vertical arch members to circumscribe the inner and outer wall structure. The space between the two horizontal members of each pair is a dead space. Separate inside and outside wall structures are provided on the inner and outer sides of the vertical arch members. Each wall structure includes an inner layer of mesh, several layers of horizontal and vertical reinforcing rod, a second layer of mesh and concrete which is applied to surround the mesh layers and reinforcing rod layers. This structure would not be very satisfactory for applying shotcrete, because much of it would tend to pass through the mesh layers and be wasted. Furthermore, the dead space would result in serious water condensation problems unless the concrete in both the inner and outer reinforced walls is adequately waterproofed. The provision of duplicate inner and outer walls would greatly increase the expense of the structure, and the complexity of making all of the bolted, clamped connections of horizontal tubular members to the vertical tubular members is impractical because it is extremely labor intensive. The structure is completely unsuitable for an underground structure that could be partially erected by a do-it-yourselfer. There is nothing in the design of either of the above disclosed structures or the structure disclosed in U.S. Pat. No. 4,155,967 which facilitates expandability and making of either elongated dome-shaped structures, barrel-shaped structures, or even composite structures.

It is another object of the invention to provide a dome-shaped structure having sufficient structural strength to support surrounding earth and earth which lies against the structure without requiring complex and unduly expensive supporting structure.

Previously, dome-shaped structures having exterior concrete or gunnite surfaces were required to be constructed by utilizing preformed dome-shaped forms or support structures to prevent sagging of the moist concrete walls prior to hardening thereof. The necessity for providing such forms added greatly to the difficulty and expense of making prior dome-shaped building structures.

Accordingly, it is still another object of the invention to provide a method of making a dome-shaped building structure without the necessity of providing expensive forms to support its concrete wall when it is moist.

It is another object of the invention to provide a method of making dome-shaped and barrel-shaped building structures which can be substantially erected by unskilled do-it-yourselfers.

It is another object of the invention to provide at least partially underground building and method of construction which does not require an excessive number of vertical arch members and heavy horizontal members which must be bolted or welded to the vertical arch members.

It is another object of the invention to provide an underground structure and method of building which allows a layer of shotcrete to be applied in full thickness in a single application without the need for waiting for sublayers thereof to dry.

It is another object of the invention to provide at least a partially underground arched structure and method for making which requires a reduced thickness for an internal layer of plaster to provide an attractive, durable interior surface that has very little tendency to crack or break loose and fall.

It is another object of the invention to provide at least a partially underground structure and method of building which avoids the problem of excessive condensation caused by passage of vapor from overylying soil into the structure where corrosion of the steel structural members can occur and wherein staining of the interior surface of the structure due to leakage of moisture can occur.

SUMMARY OF THE INVENTION

Briefly described, and in accordance with one embodiment thereof, the invention provides a dome-shaped structure suitable for residential purposes and a method of constructing the dome-shaped structure. The described basic dome-shaped structure includes a generally circular or oval concrete floor having a plurality of spaced peripheral floor brackets attached thereto and tubes for receiving lower ends of reinforcement rods embedded therein. The structure also includes an upper ring structure having a plurality of top brackets attached thereto. A plurality of semicircular arch members each have lower and upper ends which are received by the floor brackets and the top brackets, respectively. The ends of each arch member are bolted to the appropriate floor plate or ring bracket. In the described embodiment of the invention, panels including a supporting layer of stiff wire mesh and a layer of burlap fabric supported by the mesh are disposed between sections of the dome-shaped structure, each section being a region between two adjacent arch members. A first layer of horizontal reinforcing metal rods is positioned over the mesh and fabric panels. A second layer of vertical reinforcing rods is positioned over the first layer of horizontal rebar, the lower ends of the vertical reinforcing rods being inserted into the tubes embedded in the periphery of the concrete floor. A third layer of horizontal reinforcing rods is positioned over the vertical layer thereof. At crossover points of the various reinforcing rods, tie wires are utilized to tie the various pieces of reinforcing rod and the mesh layer together. Two atriums which extend to the level of the concrete slab have floors which are continguous with the concrete floor of the dome-shaped section. Vertical atrium walls which extend above the earth level are provided either by conventional masonry techniques or by providing a mesh, fabric, and reinforcing bar structure similar to that utilized for the dome-shaped structure. Upper portions of one of the atrium walls serve as side walls for a front walkway of the structure. The walkway extends partially over the front atrium to a front door of the dome-shaped structure. The outer wall of the dome-shaped structure is produced by spraying a layer of cementitious material, such as gunnite or "shotcrete", over the exposed fabric. The cementitious material surrounds the reinforcing rods, which become embedded in the cementitious material when it hardens. Subsequently, an interior layer of gunnite or shotcrete is sprayed over the entire interior surface of the dome to provide an interior wall and ceiling surface. A roofed pentagon structure is disposed above the connecting ring at the peak of the dome-shaped structure. A plurality of windows are provided in the pentagon structure to provide adequate natural lighting of the upper level of the dome-shaped structure. Openings into the atriums are provided in the outer wall of the lower level of the dome-shaped structure to admit outside light therein; sliding glass doors are utilized to provide entry into the atriums from the lower level of the dome-shaped structure. A central ring supports inner ends of a plurality or radially disposed horizontal beams which extend to and are attached to a plurality of the arch members to support the floor of the upper level. Earthen material removed during excavation of the hole in which the dome-shaped structure is constructed is moved to cover the outer wall of the dome-shaped structure. Vertical atrium walls prevent earthen material from entering the atriums. Side walls extending from the outer wall on both sides of a front door of the dome-shaped structure are provided to prevent earthen material from falling into the entry way. In the described embodiment of the invention, the main entrance includes a walkway which extends over and partially covers the front atrium of the structure. An overhead deck with peripheral decorative railing serves as a roof which keeps rain out of the front atrium and as a recreational area which can be entered by walking up the sloped earthen material which covers the upper portion of the dome-shaped structure. The rear atrium is uncovered. A rear deck with side walls protects a rear entry into the back yard behind the dome-shaped structure.

DESCRIPTION OF THE INVENTION

Figure 1:
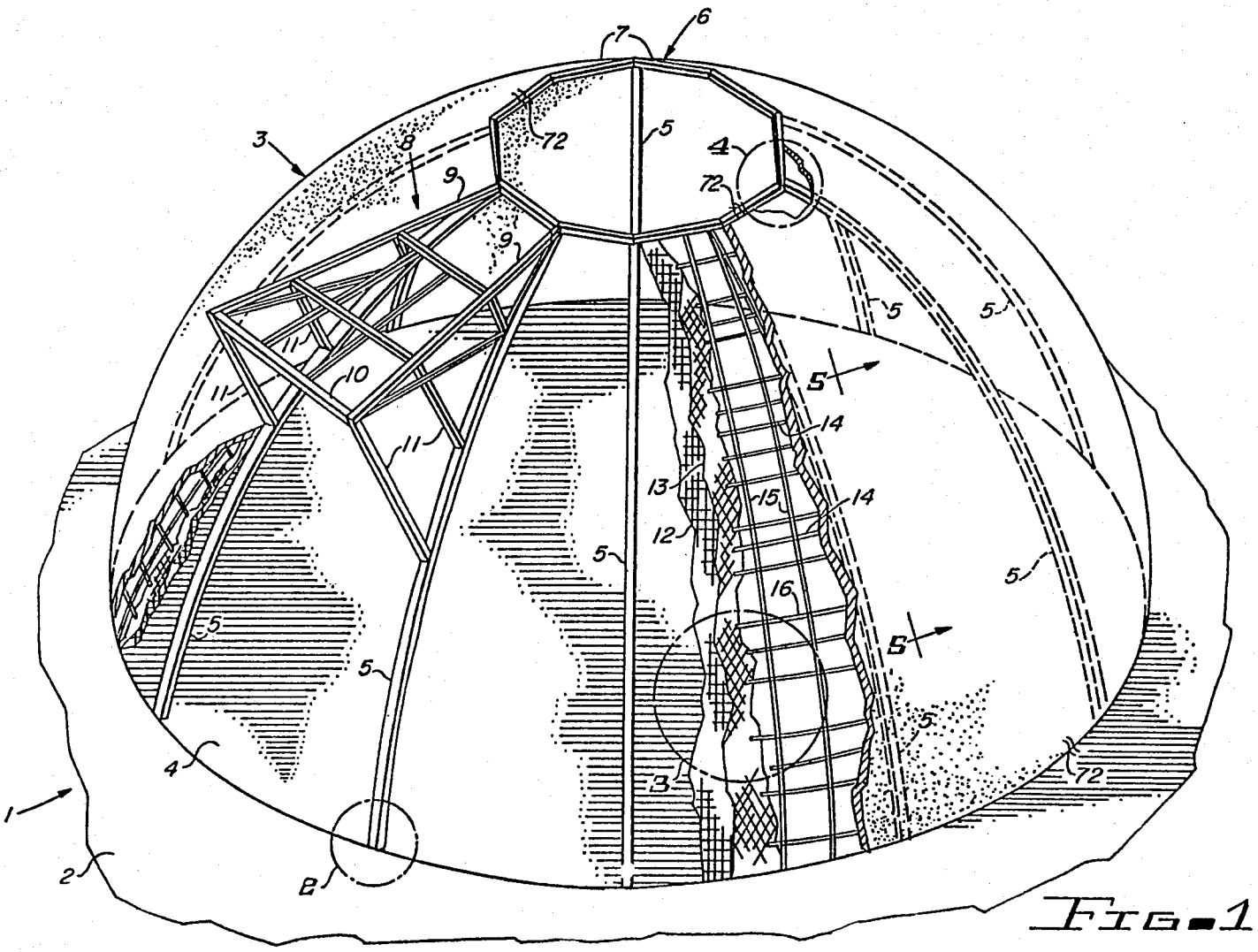
FIG. 1 is a partial cutaway perspective view of the dome structure of the present invention.

The basic structure of the dome portion of the underground dwelling structure of the present invention can best be understood with reference to FIGS. 1-5. (It should be noted that the term "underground" as used herein and in the claims refers to structures which are only partially located beneath the surface of the earth or are partially covered with earthen material.) In FIG. 1, the underground residence 1 is shown disposed upon an underground floor surface 2 which has been excavated to a depth of roughly 8 to 10 feet beneath the surrounding ground level. A poured concrete floor slab 4 supports the dome walls of dome structure 3. In the illustrated embodiment of the invention, dome structure 3 includes ten semicircular arch members 5 which support the outer walls, subsequently described. Each of arch members 5 is essentially a semicircular I-beam, the lower end of which is rigidly attached to a peripheral portion of circular concrete floor 4. (It should be noted that although a generally hemispherical dome-shaped embodiment of the invention having a circular floor is described herein, an oval or oblong dome-shaped structure also can be provided using the techniques and structure described herein. Reference numeral 72 of FIG. 1 indicates break lines along which the floor and wall structure could be elongated to provide such an oblong configuration.) The upper end of each of arch members 5 is connected to a decagon ring 6, which is formed of steel.

The manner of connecting the lower end of each arch member (hereinafter referred to as arch beam 5) to concrete floor 4 is shown in more detail in FIG. 2 wherein it is seen that concrete floor 4 has a deepened foundation portion 18 extending along the peripheral boundary of concrete floor slab 4. A pair of floor brackets 22 are spaced from each other by an amount sufficient to accommodate the web of the lower I-beam structure of arch beam 5. Floor brackets 22 are bolted into concrete floor 4 by means of bolts 23. Each of floor brackets 22 has a pair of holes 28 in the vertical portion thereof. When the lower end of arch beam 5 is inserted into the space between floor plates 22, holes 19 in the web of arch beam 5 are aligned with holes 28 in floor brackets 22. Bolts 20 and nuts 21 are deployed to permanently and rigidly attach arch beam 5 to floor brackets 22. All of the arch beams 5 are attached to floor 4 in this manner.

Figure 4:
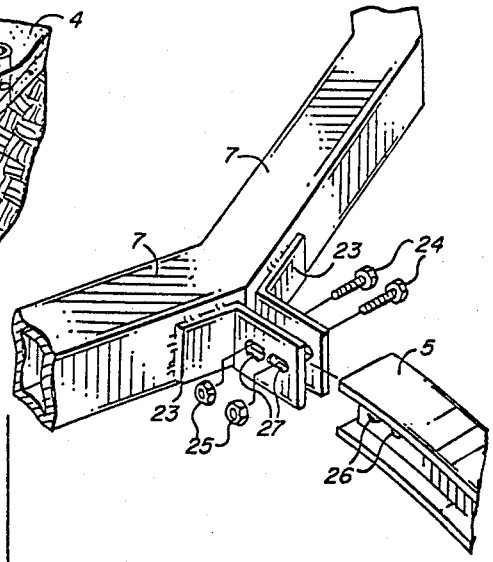
FIG. 4 is an enlarged perspective view of detail 4 of FIG. 1.

The details of attachment of the upper end of each of arch beams 5 to decagon ring 6 are shown in FIG. 4, which is an enlarged view of detail 4 of FIG. 1.

Referring to FIG. 4, a pair of spaced angle brackets 23 are welded to the outside surface of adjacent straight sections constituting decagon ring 6. Each of the brackets 23 has a pair of elongated holes 27 therein. The two outer plates of each of brackets 23 are parallel and are spaced apart by sufficient distance to accommodate the web member of arch beam 5, which has a pair of holes 26 which are aligned with holes 27 when the web member of arch beam 5 is slid as far as possible into the space between brackets 23. Bolts and nuts 24 and 25 are then tightened to rigidly connect the upper end of each of arch beams 5 to appropriate connecting brackets of decagon ring 6.

A front deck support structure 8 is attached between two of arch beams 5, as shown in FIG. 1. Deck support structure 8 includes two horizontal metal beams 9 extending horizontally outward from one of the decagon ring members 7. Each of horizontal members 9 are supported by a plurality of vertical or semi-vertical support members 11, which are supported as shown by respective ones of arch beams 5. A second rear deck support for supporting the rear deck 40 is omitted from the drawing in FIG. 1 for convenience. Suitable cross members between parallel horizontal beams 9 are attached thereto to provide a suitable support for front deck 38, shown in FIG. 6.

The wall structure of dome 3 is best explained with reference to FIGS. 1, 3 and 5. On the interior side of the wall structure, but on the outer side of the arch beams 5, a layer of stiff or semi-rigid wire mesh 12 supports a layer of fabric 13, such as burlap. The mesh can be steel mesh of a type referred to as "6-6-10-10 steel mesh" in the trade. A "layer" of spaced horizontal rebar members 14 are disposed at approximately one foot centers. A plurality of vertical rebar sections 15 are also spaced at approximately one foot centers at the base of dome structure 3. The vertical rebar members 15 have lower ends which fit into tubes 71, which are embedded in concrete 4, as shown in FIG. 2.

A third layer of rebar includes horizontal spaced members 16. A third layer of rebar pieces includes horizontal pieces 16, spaced at two foot centers. The horizontal pieces of rebar are either tied to the outer surfaces of the arch beams, or are secured by means of holding tabs (not shown) which may be provided on the outer surfaces of the arch beams.

Figure 3:
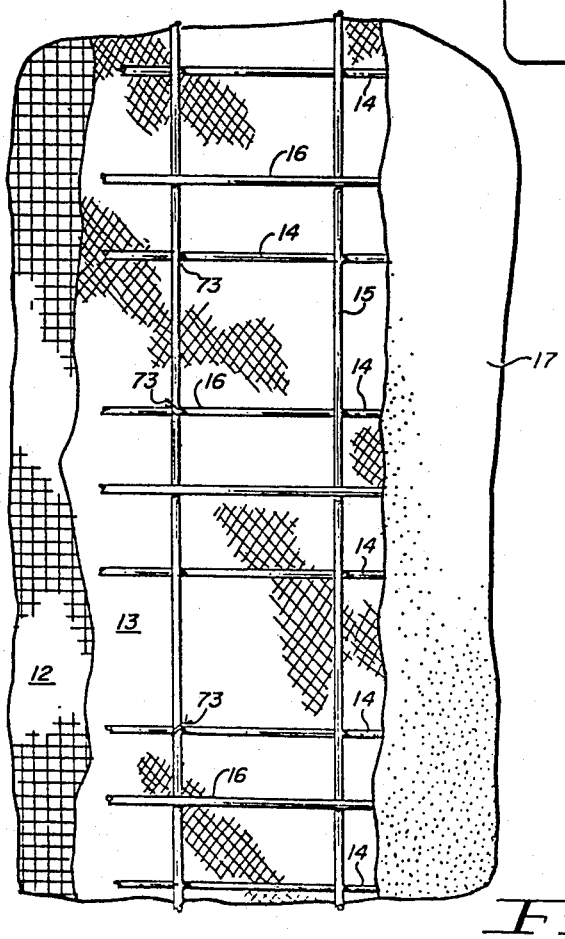
FIG. 3 is an enlarged plan view of detail 3 of FIG. 1.

As seen in FIG. 3, wire ties 73 are utilized at all of the various intersections of rebar pieces 14, 15 and 16 to tie the various sections of rebar and the underlying mesh and burlap together, thereby effecting substantial support for the burlap layer when moist gunnite is later sprayed thereon. In some cases, it is desirable to initially provide a number of ties to tie only certain rebar pieces together without engaging the mesh/fabric layer in order to conveniently effect proper initial positioning of the various horizontal and vertical pieces of rebard.

Figure 5:
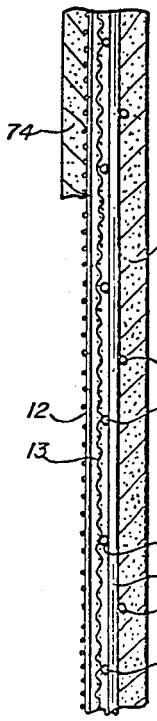
FIG. 5 is a section view taken along section line 5—5 of FIG. 1.

After all of the above mentioned sections of rebar and mesh/fabric are tied together, gunnite or a moist substance known in the trade as "shotcrete" is sprayed on the outer surface to provide an outer gunnite layer 17, as shown in the cross-sectional view of FIG. 5. Later, a layer of gunnite 74 is sprayed on the interior surface of the structure to provide an interior wall which can be finished having a pleasing plaster-like appearance. The thickness of the interior gunnite layer 74 is approximately several inches. The thickness of the composite outer wall layer, including the mesh 12, the burlap fabric 13, and the three layers of rebar is approximately four inches. The sprayed on gunnite or shotcrete completely surrounds the two outer layers of rebard, reinforcing the gunnite.

The rippled surface of burlap fabric 12 in FIG. 5 as it stretches between the mesh wires of mesh 13 due to the weight of the moist gunnite layer, provides a rough, uneven surface to which the sprayed on interior gunnite layer 74 can securely and safely adhere.

Other structural features of the underground dome-like dwelling structure can be best explained with reference to FIGS. 6–10. One important feature is that the dome-like structure 3 has an upper level with a floor 52 and a lower level with floor 4. Brackets for receiving the outer ends of the radial wood beams 52' which support second level floor 52 are bolted to or preattached to the inner surfaces of appropriate ones of arch beams 5. The inner ends of the radial wood beams are supported by center support 47.

Figure 9:
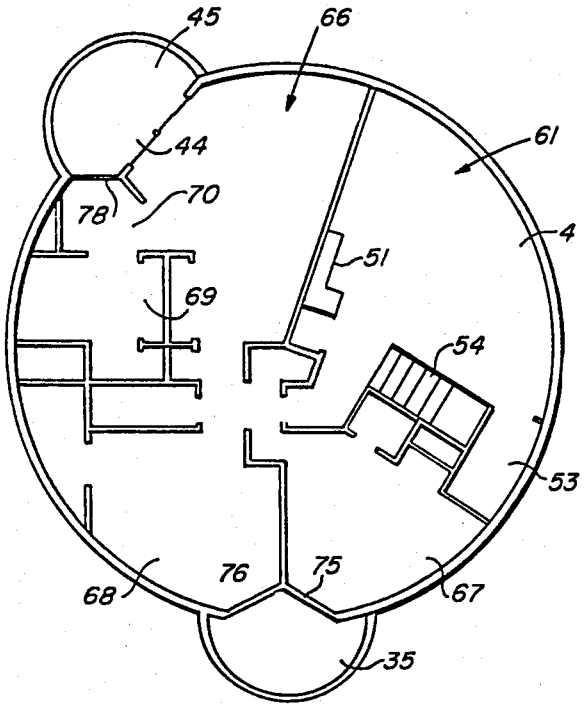
FIG. 9 is the lower level plan view of the dome-shaped structure of FIGS. 1-8.
Figure 10:
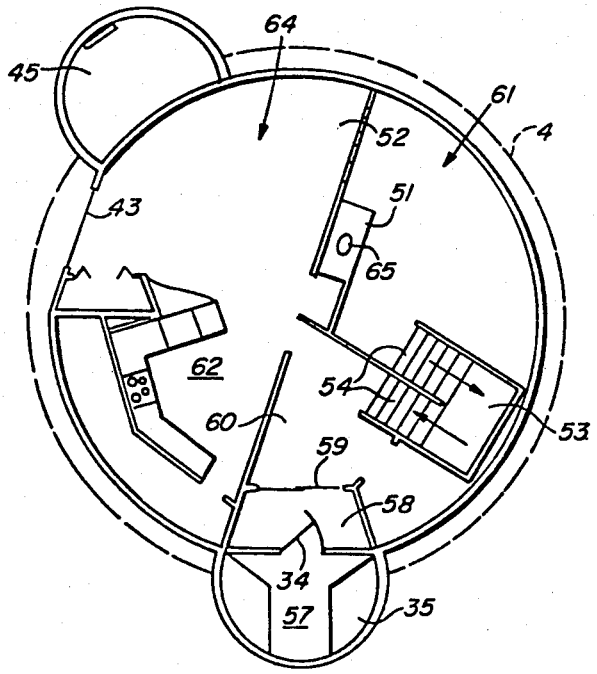
FIG. 10 is an upper level floor plan of the dome-shaped dwelling structure of FIGS. 1-8.

A roofed pentagon structure 31 (through which a chimney 50 for fireplace 51 located on a lower level extends) has a plurality of side windows 37. Light admitted through windows 37 passes through decagon ring 6 and provides ample daylight for the entire upper level. The lower level floor plan and the upper level floor plan are shown in FIGS. 9 and 10, respectively. Referring to FIG. 9, the lower level includes a living room 61, the ceiling of which is formed by the interior wall of dome structure 3. As is seen in FIG. 10, the upper level floor does not extend over living room area 61. Referring again to FIG. 9, it is seen that two atriums, namely front atrium 35 and rear atrium 45 provide ample natural lighting to master bedroom 66 and room 70. A pair of sliding glass doors 44 provide access from master bedroom 66 into atrium 45. Bedrooms 67 and 68 have windows 75 and 76, respectively, which permit ample entry of outside light into bedrooms 67 and 68.

Referring now to FIG. 10, the upper level includes a walkway 57 which partially covers atrium 85 and a front entrance door 34. A closed region 58 is optionally provided to decrease loss of heat or cold from the interior of underground residence 1 during entry or exit therefrom through door 34. A sliding glass door 59 provides access from enclosed region 58 into foyer 60. A person standing in the foyer can then enter the kitchen area 62 or dining area 64 of the upper level through door opening 77, or can go downstairs into the living room or bedroom areas by means of stairs 54 and landing 53.

A rear exit 43 from dining area 64 is provided by means of sliding glass doors 43 into the back yard.

Figure 6:
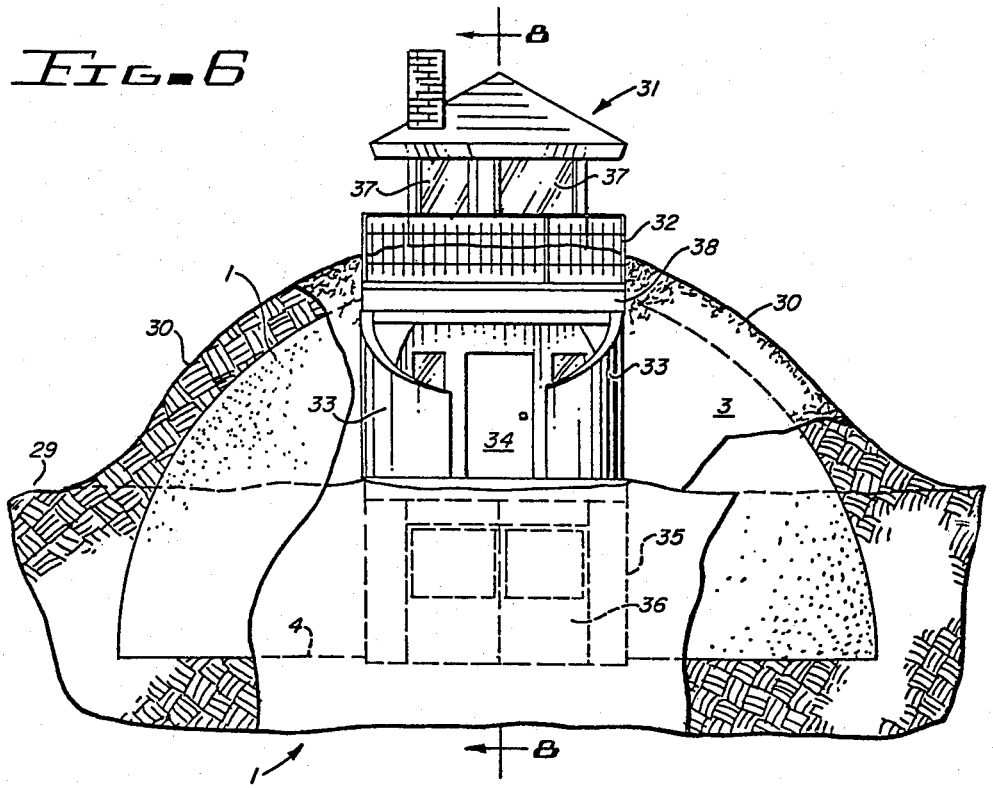
FIG. 6 is a partial cutaway front elevational view of the under earth dwelling structure of the present invention.
Figure 8A:
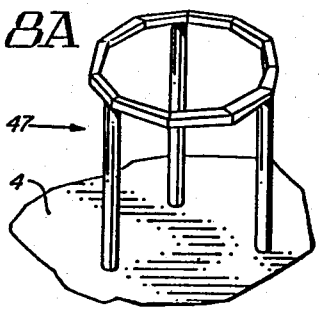
FIG. 8A is a partial perspective view of the center second floor support structure shown in FIG. 8.
Figure 8:
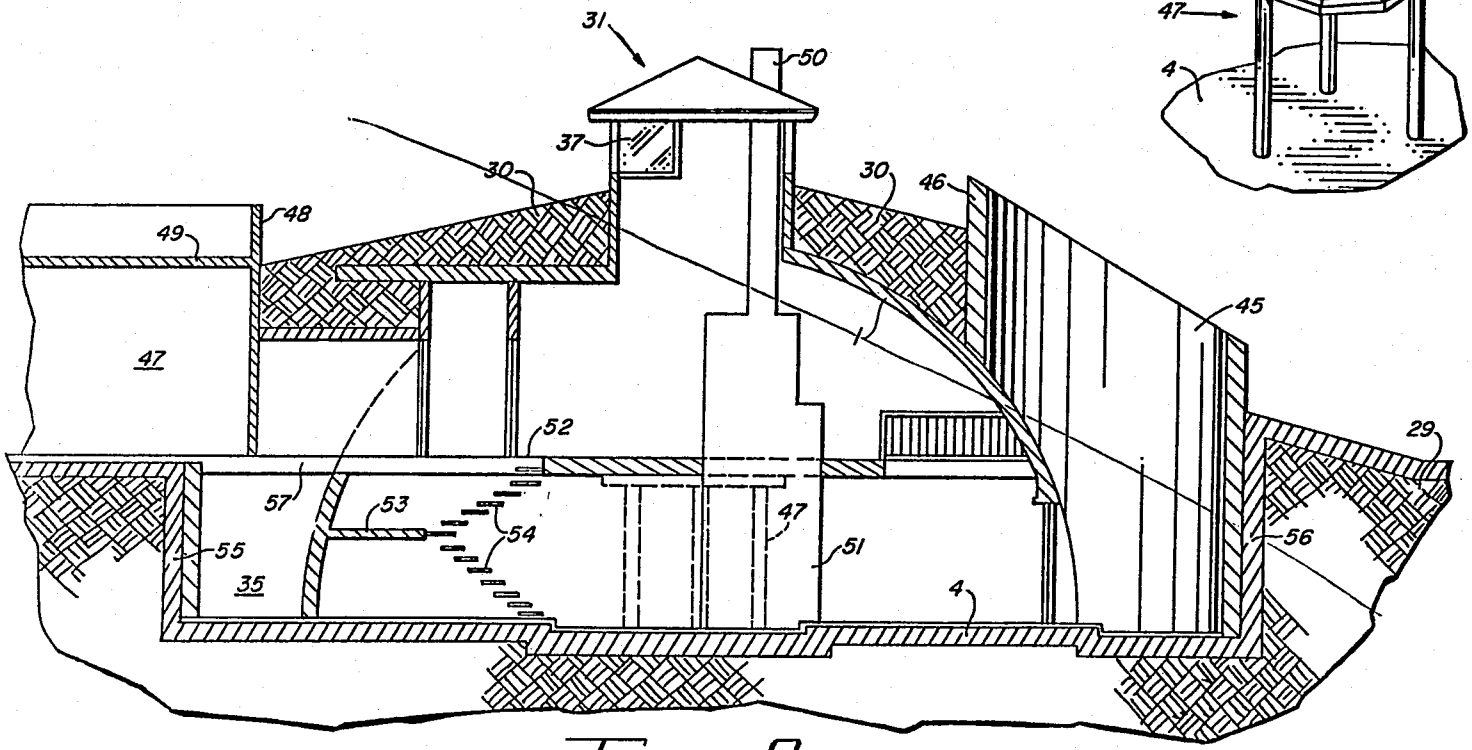
FIG. 8 is a partial modified sectional view of the dome-shaped under earth dwelling structure of FIG. 1-7.

As shown in FIG. 8, which is a sectional view taken through the center of FIG. 6 along section line 8—8, earthen material is "bermed up" to cover the entire exposed outer surface of dome structure 3 to a depth of at least several feet. This earthen cover provides great insulating and heat storage capabilities which maintain the temperature in underground residential building 1 substantially cooler in summer, warmer in winter, and generally more uniform than would be the case for a conventional above-ground dwelling structure.

Rear atrium 45 is partly surrounded by a large cylindrical wall structure against which the earthen material 40 rests, thereby preventing the earthen material from falling into rear atrium 45.

It should be noted that the sectional views of both front atrium 35 and rear atrium 45, which do not lie along a single diameter of the hemispherical dome-like structure, as is readily apparent in FIGS. 9 and 10.

An above-ground garage 47 is optionally provided on the left side of the dome-shaped underground structure as seen from the front thereof. The wall 48 of the garage structure extends above the roof 49 thereof, and includes an entry way (not shown) from the surface of the covering earth 30, enabling a person to utilize the roof 49 as a walled deck which can be entered into by walking up the earth covering 30 to the entry way.

Referring to FIG. 6, which is a front elevational partial cutaway view of underground residence 1, a pair of curved cutaway side wall or cowl members 33 extend from the outer surface of the dome-shaped structure 3. Cowl members 33 can be formed in the same manner as the wall of dome-shaped structure 3, utilizing mesh and fabric panels, rebar, and sprayed on gunnite covering both the inner and outer surfaces. The gap between the front edges of cowl members 33 forms an entry way through which a person can walk over walkway 57 to front door 34. A roof deck 38 rests on the horizontal members 39 of deck support 8 of FIG. 1. Rail 32 is provided mainly for decorative purposes, although deck 38 can be entered by a person who walks up the earthen cover 30 approximately to the base of penthouse 31.

The lower portion of front atrium 35, shown in dotted lines in FIG. 6, is accessible by means of sliding doors 36 from lower bedrooms 67 and 68.

It should be noted that for convenience the visible portion of rear deck 41 and rail 40 (FIG. 7) has been omitted from FIG. 6.

Figure 7:
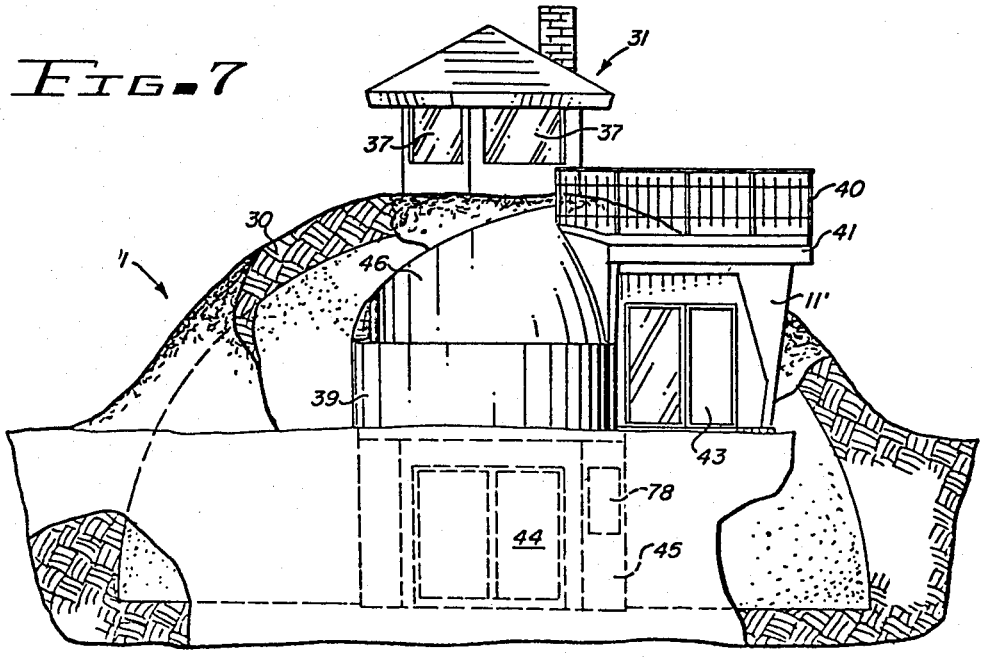
FIG. 7 is a partial cutaway rear elevational view of the under earth dome-shaped residential structure of the present invention.

Referring now to FIG. 7, a rearview of the underground residence 1 is shown, wherein the wall of closed atrium 45 extends substantially above the normal ground level. A portion 46 extends substantially above the remaining upper edge portion of the wall 39 of atrium 45 for decorative purposes. Door 43 provides an exit from the interior of underground structure 1 to the back yard thereof. A support structure 11' similar to support structure 8 of FIG. 1 supports rear deck 41. Decorative rear deck railing 40 is disposed along the periphery of rear deck 41. Sliding doors 44 provide access into rear atrium 45 from master bedroom 66. Window 78 provides outside lighting into room 70.

The foregoing underground dome structure has numerous advantages which make it suitable for construction by a "do-it-yourself" homebuilder. All of the elements shown in FIG. 1 for the basic dome structure 3 except the gunnite can be prefabricated and marketed in kit form. The curved I-beams from which arch beams 5 are constructed can be preformed and the end holes 19 and 26 can be predrilled. Decagon ring 7 can be prefabricated with the upper brackets 23 prewelded thereto. The lower floor brackets 22 can be readily provided in a kit, along with the rebar shown in FIG. 3. The mesh fabric layers can be made into single panels preformed to fit the sections between a pair of adjacent arch beams 5. The center support 47 of FIG. 8A, floor anchors therefore (not shown), and radial wood beams for supporting floor surface 52 can all be provided as part of a basic kit. Similarly, the members of which pentagon 31 is formed can also be prefabricated and sold as part of a kit. The interior floor plan is extremely versatile since there are no roof supporting interior walls. Thus, the interior walls can be placed anywhere they are desired. Similarly, the atriums can be placed wherever they are desired to provide adequate interior light in the lower level. Three or more atriums could be utilized, if desired.

The first step in the construction process will ordinarily be to excavate the building site of the underground residence to a depth of eight to ten feet. Ordinarily, the hole should extend at least five or six feet beyond the desired boundary of the floor (including the atrium floors) of the intended structure. All of the required plumbing for the lower level and duct work for air conditioning, if desired, is positioned in the floor site before the circular or oval concrete floor 4 is poured therein. The rebar receiving tubes 71 are embedded in the moist floor concrete or else are prepositioned before the floor concrete is poured. Rebar receiving tubes 71 greatly facilitate positioning of the vertical rebar rods 15.

The earthen material removed during excavation of the hole in which the floor structure is poured is simply pushed aside, as later it is pushed back into the excavated hole against the concrete outer surface of the dome, and is used to provide the upper earthen covering 30 shown in FIGS. 6–8.

Figure 2:
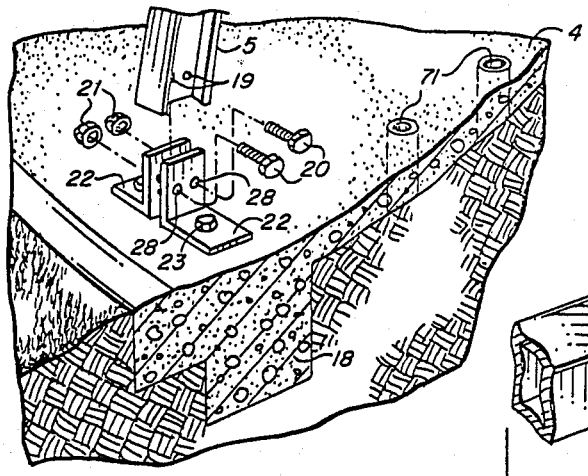
FIG. 2 is an enlarged perspective view of detail 2 of FIG. 1.

After the floor concrete is poured, and while it is still moist, the floor brackets 22 of FIG. 2 are positioned and bolted into the concrete by means of bolts 23. At the same time, brackets for center support 47 of FIG. 8A can be centrally positioned and bolted into the concrete floor.

After the floor concrete has hardened, a crane or other support is provided to centrally position decagon ring 6 above floor 4. Several workers, preferably three, position each of the arch beams 5 by dropping its lower end into the space between a pair of floor brackets 22 and placing its upper end between a pair of upper brackets 23 attached to decagon ring 6 and bolting the upper ends of the arch beam to the decagon ring and floor slab, respectively. After attachment of the deck support 8 (the details of which attachment are not shown because they could be readily provided by those skilled in the art), and after determining the location of the two atriums, vertical atrium walls can be built of cement block if desired, instead of using the above described composite mesh/fabric/rebar structure previously described.

The technique for making the outer wall of dome-shaped structure 3 includes the following steps. First, the respective panels of mesh and burlap or other suitable fabric are disposed between and supported by each adjacent pair of arch beams. Note that the mesh and fabric can be precut into suitably sized panels and pretied together to make easily manipulated composite panels which are easily installed. The lower layer 14 of horizontal rebar pieces is then positioned, each piece extending between the various arch beams and attached thereto by means of tie wire or preformed bendable brackets (not shown) attached to the respective arch beams. Next, the lower ends of vertical rebar rods 15 are all inserted into the respective rebar receiving slots 71 and are bent to lie against the underlying horizontal layer of rebar members 14. The outer rebar layer rods 16 are then positioned over the vertical rebar rods 15, and at each intersection of two or more pieces of rebar, those rebar rods and the underlying mesh and fabric are tied together by means of tie wire pieces 73. The various pieces of rebar are bent or flexed slightly during the above positioning steps so that the rebar pieces are curved in correspondence with the slope of dome-shaped structure 3. It should be noted that the above described method of installing the mesh, fabric, and rebar is merely exemplary. Another suitable approach would be to first install the vertical rebar rods, then position the inner layer of horizontal rebar rods behind the vertical rebar rods, and then position the outer layer of horizontal rebar rods on the outer side of the vertical rebar rods. Then the above mentioned composite panels of fabric and rebar can be positioned behind (i.e., on the inner side of) and tied to the rebar layers.

Suitable framework for the front and rear atrium walls and the cowls 33 (FIG. 6) can be similarly formed to provide a foundation for spraying gunnite thereon.

The next step is to spray approximately 4 inches of gunnite or "shotcrete" onto the mesh/fabric layer, whereby the various layers of rebar become embedded in and reinforce the gunnite layer 17 when it hardens.

Before the gunnite layer 17 is sprayed onto the dome shaped structure 3, supports must be provided at approximately four equally spaced locations of each section (between adjacent arch beams such as 5) to prevent slight sagging of the rebar, mesh and fabric as the heavy gunnite or shotcrete is sprayed thereon. This can easily be accomplished by providing four T-shaped supports of various lengths which are wedged between the floor 4 and the inner surface of the mesh/fabric to support it at the four spaced points before spraying of the gunnite onto the exterior surface thereof.

Next, the radial beams on which the second floor 52 is supported are installed by resting their inner ends on the ring of center support 77 and bolting their outer ends to braces attached to the midpoints of arch beams 5.

Pentagon 31 can be installed and assembled without utilizing any special techniques, its structure and assembling method therefore are not described in detail. Remaining details of the construction of underground residence, including pushing the earthen material 30 over the exposed gunnite outer wall surface, spraying interior gunnite layer 74 of the interior wall surfaces of the dome-shaped shell, installing satisfactory interior stud and wall materials and the like can be readily done by those skilled in the art and therefore are not described herein in further detail.

Figures 11, 15A, 15B, 15C, 15D:
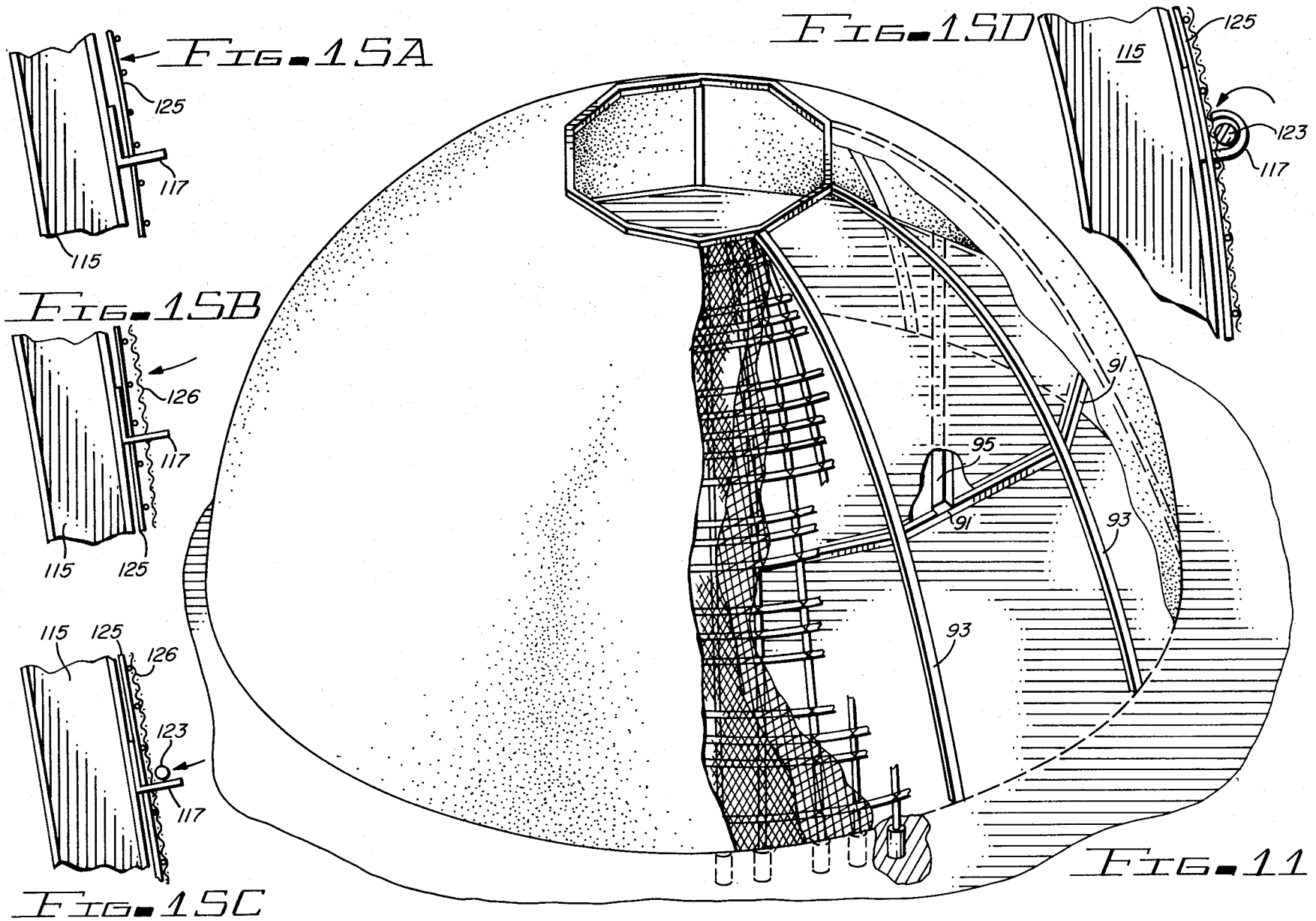
FIG. 11 is a partial perspective cutaway view illustrating an alternate method for supporting a second story floor in the structure of FIG. 1.
FIGS. 15A-15D are section views useful in explaining the method of erecting the mesh, fabric, and rebar structure of the present invention.

Referring now to FIG. 11, an alternate scheme for supporting an upper level floor is shown. A plurality of horizontal I-beams 91 are bolted to extend between respectively adjacent vertical arch members 93. One or more long beams composed of laminated boards, referred to in the trade as a "glue-lam beam", extends between and is supported by appropriate ones of the horizontal steel channel beams 91. These glue-lam beams and the horizontal steel channel members 91 support an upper level floor.

Figure 12:
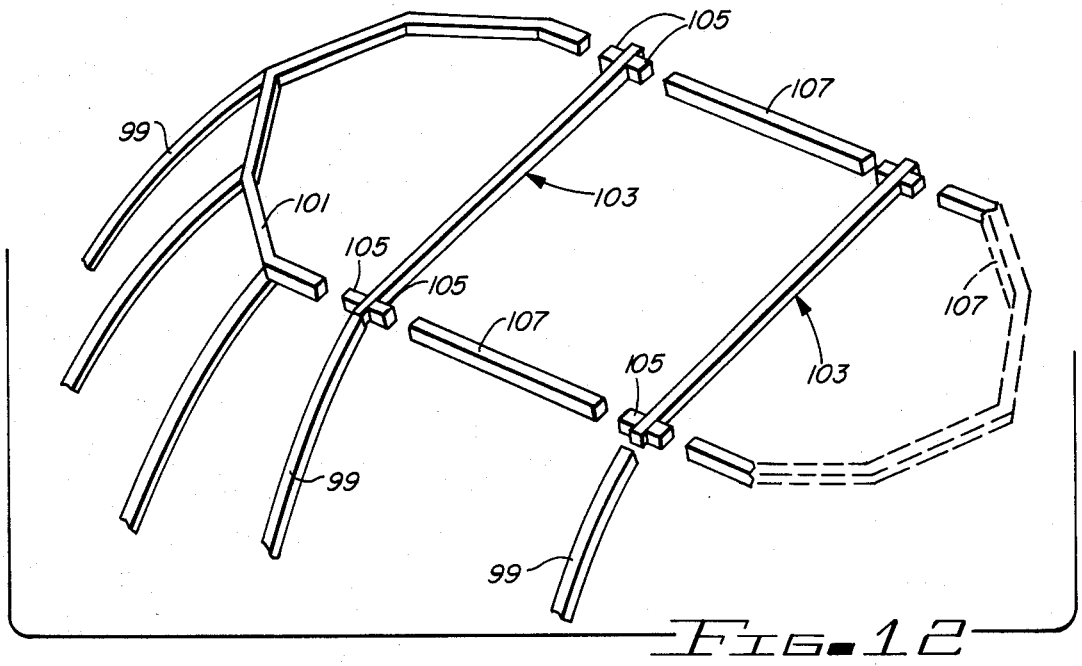
FIG. 12 is a partial perspective view illustrating an expandable frame structure and construction technique.

Referring now to FIG. 12, an expandable structure is shown in which the previously described ring 6 is replaced by an expandable ring including two "half collar" members designated by reference numeral 101. Each of the half collar members 101 includes six straight pieces of rectangular steel tubing welded together to form a semicircle in the structure shown in FIG. 12. The upper ends of each of the arched beams 99 are attached to suitable tabs that have been welded to the joints of half collar members 101 in the manner previously described with reference to FIG. 4. The free ends of each half collar member 101 are open, so if an elongated dome-shaped structure is desired, a cross member 103 having two transverse rectangular end pieces 105 welded thereto in the manner shown can be snugly inserted in the open ends of half collar member 101 and secured by bolts, therethrough (not shown). The opposite ends of each of the transverse end pieces 105 are respectively inserted into open ends of two extension tubes 107. The length of each of the extension tubes 107 is essentially equal to the separation at the base of the dome structure between adjacent arch members 99. At the opposite ends of the extension tubes 107 another cross member 103 is provided, with its transverse end pieces 105 inserted into the open ends of extension tubes 107. As many extension tubes 107 and cross members 103 are added in this fashion as are needed to produce the desired length of the elongated dome-like structure.

The cross members 103 can be tubular, or can be composed of I-beams with transverse plates welded to their end faces, to which mating plates that are welded on the upper ends of each of the arch emmbers 99 can be bolted.

If the dome-like structure being constructed is to be dome-shaped at both ends, a half collar member 101 identical to the one shown at the left end of the structure shown in FIG. 12 also is attached to its right end. However, in some instances, it is desirable that only one end of the structure be dome-shaped, in which case, a half collar member 101 is attached to only one end. The front end of the building then will not be dome-shaped, and conventional construction techniques can be used to provide a vertical wall therefore. This type of structure may be especially useful for both residential and commercial purposes when the structure is built on a sloping hill. The side of the hill is excavated to provide a hole with a level bottom which is deep at its rear end, but which at its front end is approximately at the original ground level. An atrium, such as the ones previously described, can be provided at the rear end of the structure and the sides which can be covered with earth when the structure is complete. A light emitting structure similar to the one previously described and shown in FIGS. 6–8, only elongated to match the semi-ring composed of half-collar 101 and the extension tubes 107 can be provided on top to emit light. Especially if the vertical end wall is oriented south and consists largely of glass, the solar insulation received in the winter months can make this kind of structure very practical and energy efficient.

Figure 13:
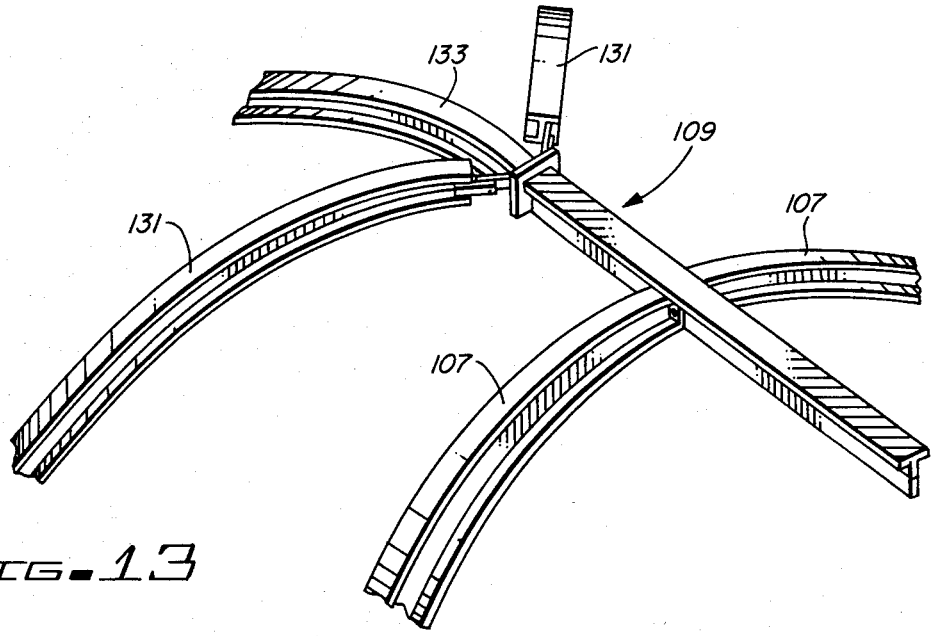
FIG. 13 is a partial perspective view illustrating another frame structure and construction technique.

Referring now to FIG. 13, an alternate structure is shown which is useful in conditions in which it would not be desirable to have a light-emitting opening in the top of the structure, but would be desirable to have the option of expanding the structure's length. In this case, most of the arched beams 107 can be identical to those used in FIG. 13, but instead of using half-collar members such as 101, a "star" end connector 127 can be used for connection to the arch members 131 and 133, thereby providing a semi-spherical end portion of the elongated structure. As many T-members 109 can be connected together as are needed to produce the desired length of the building. A second star end connector can be provided on the forward end of the structure as shown in FIG. 13 for connection to additional arch beams such as 131 and 133.

Figure 13B:
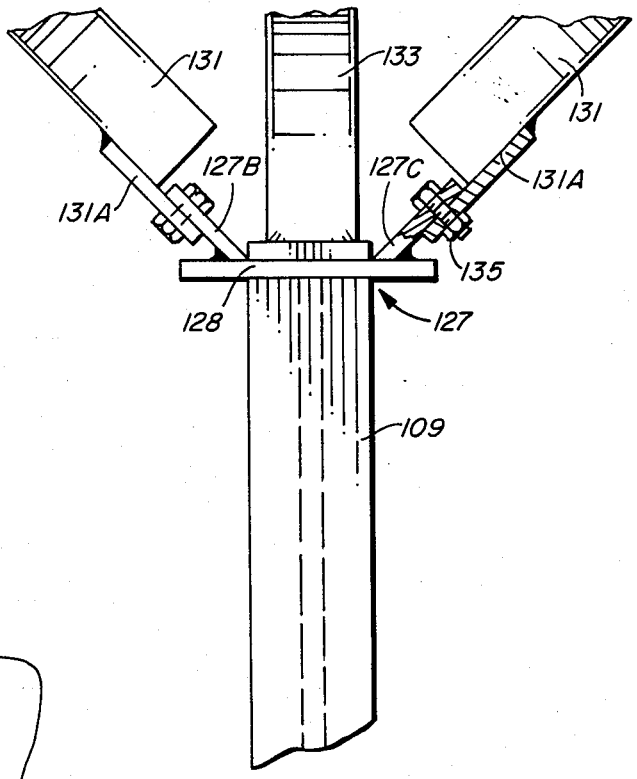
FIG. 13B is an enlarged drawing illustrating connection of one dome-shaped end portion of the structure shown in FIG. 13.
Figure 13A:
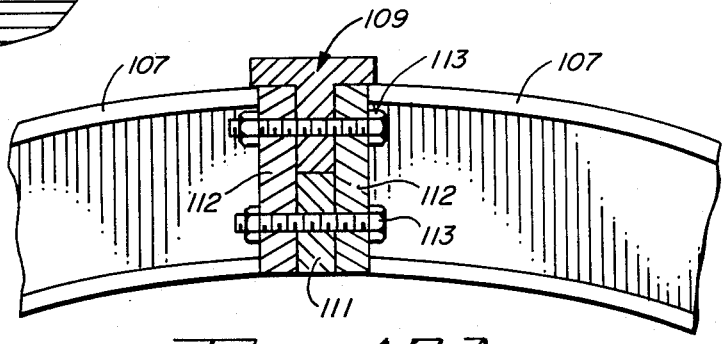
FIG. 13A is a partial section view illustrating a technique for attaching the arch members of FIG. 13 to the T-member of FIG. 13.
Figure 13C:
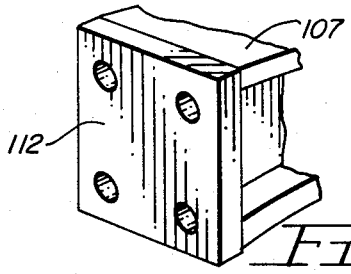

FIG. 13A shows how end plates 112 on the ends of arch members 107 can be bolted by means of bolts 113 to the web of T-member 109. A spacer 111 of the same thickness as the web is used to facilitate the bolting of the lower belt 113.

FIG. 13B shows in more detail the structure of the star end connector 127, which includes a large rectangular plate 127A to which two (or more) angular tabs 127B and 127C are welded. The arched beams 131 which are connected to the tabs 127B and 127C each have a tab 131A welded thereto. Bolts 135 are used to bolt the tabs 131A to the angular tabs 127B and 127C. Arch beam 133 is identical to arch beams 107 in FIG. 13, and has an end plate 128 which is bolted to plate 127 of T-member 109.

The structure shown in FIG. 13 is particularly suitable for fall-out shelters, and also for some structures such as garages that might be connected to a dome-like or barrel-shaped residential structure.

A very important advantage of the structures and techniques illustrated in FIGS. 12 and 13 is the flexibility that is provided to the builder by allowing expansion of the basic dome-shaped configurations to obtain different sizes and shapes of structures. All of the arch members are interchangeable except the arch member 131 which is connected to the inclined tabs of star connector 121. No welding is required in the construction, so the frame structure can be erected by do-it-yourselfers without undue difficulty.

Figure 14:
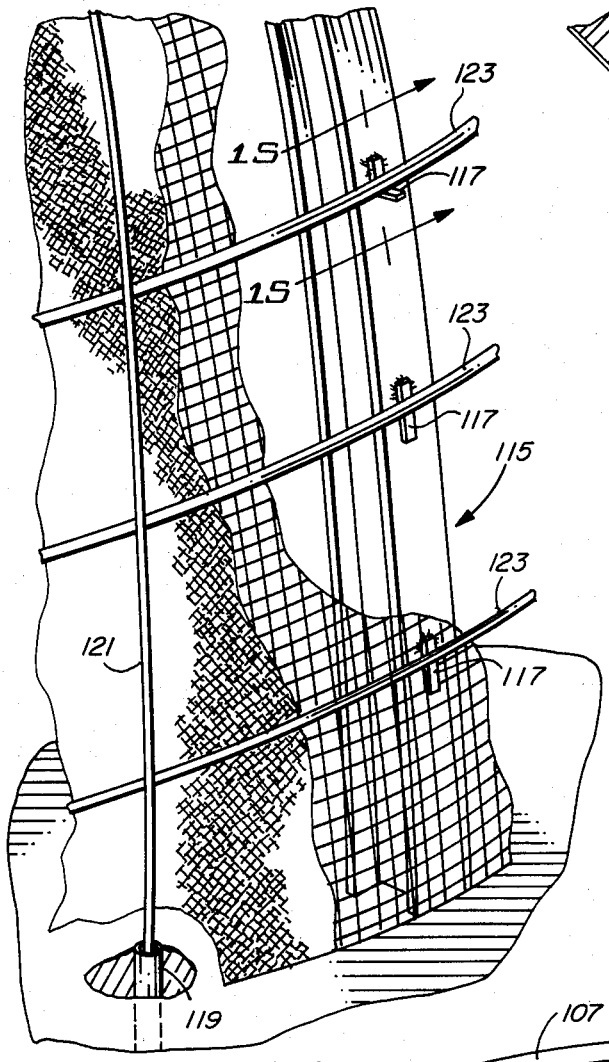
FIG. 14 is a partial perspective view illustrating the manner in which tabs for holding horizontal rebar rods are attached to the outside surfaces of the arch members shown in FIGS. 11, 12 and 13.

Referring now to FIG. 14, the previously mentioned tabs that can be used for convenient installation of the horizontal rebar are shown. They are designated by reference numeral 117. Initially, these tabs, which are composed of maleable iron or steel, are welded flat against the outer surface of an arch member, such as 115 in order to facilitate shipping and safe handling of the arch members. After the arch members have been erected to form the basic dome-shaped structure, the first step in the construction process is to bend the tabs 117 outward, as indicated in FIG. 15A. This can be done easily with the claws of a hammer or small crowbar. Next, pre-shaped panels 125 consisting of stiff wire mesh with burlap fabric attached thereto are positioned over the portions of the structure on which horizontal rebar is to be installed next, or else the precut wire mesh and burlap fabric panels are positioned over the entire dome-like structure. In accordance with the present invention, it is preferable to use prefabricated mesh/fabric panels, because it is very difficult to make large pieces of mesh from a cylindrical roll conform to a spherical shape. Next, pieces of rebar are properly positioned, as indicated by reference numeral 23 in FIG. 14. As indicated in FIG. 15B, reference numeral 125 represents the placement of a precut wire mesh and burlap fabric panel against the outer surface of arch member 115. Small pieces of tie wire can be used, if desired, to temporarily attach the mesh/burlap panel 125 to the outer surface of the structure.

As indicated in FIG. 15C, the horizontal rebar 123 is positioned on the bent tabs 117, and held there as the tabs 117 are bent around the rebar 123, as shown in FIG. 15D. This bending can be accomplished by pounding with a hammer. After the horizontal rebar has been installed in this fashion, the previously mentioned PVC tube receptacles for the lower ends of the vertical rebars embedded in the foundation, and designated by reference numeral 119 in FIG. 14, are installed. An advantage to the above described technique is that persons untrained in handling of rebar can easily position and secure both the horizontal and vertical rebar pieces at precisely the correct spacings.

If desired, after the vertical rebar has been installed another "layer" of horizontal rebar can be provided to give additional strength, in the manner indicated by reference numeral 16 in FIGS. 1, 3, and 5, previously described.

Figure 16A:
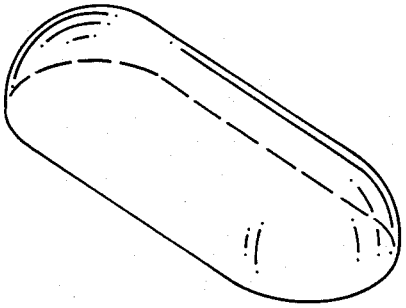
FIGS. 16A-C are diagrams illustrating the basic types of structures that can be erected using the elements shown in FIG. 12.
Figure 16B:
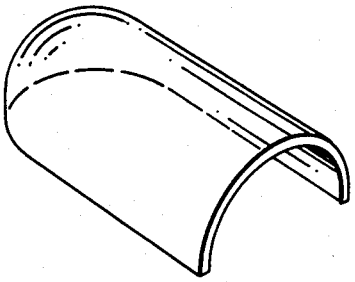
Figure 16C:
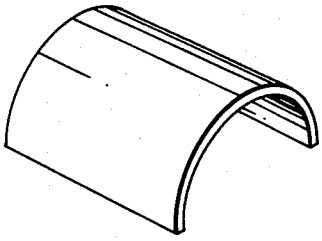

In FIG. 16, several alternate structures that the above-described expandable system facilitates construction of are shown, including an elongated dome-shaped structure, a modified dome-shaped structure with a vertical wall at one end, and finally, a "barrel-shaped" structure with vertical walls at both ends.

The above-described structures and technique for building above ground, underground, and partially underground structures has numerous advantages over anything that has been previously proposed. Using the disclosed prefabricated arch members, half-collar members, extension tubes, cross members, star connectors and T-members, and mesh/burlap panels, a considerable variety of different sized and shaped structures can be built. The "quality control" of the system is "built in" by the proper manufacture of the above-identified components, so that erection of a structure is a relatively simple matter requiring no welding and only alignment of bolting plates and bolt holes and tightening of bolts. Use of precut wire mesh and burlap fabric panels avoids difficulties that would be encountered for making sections of mesh cut from a roll conform to the spherical shape of the dome, and enables a do-it-yourselfer to perform this part of the construction quite easily. The mesh is sufficiently durable, as is the burlap fabric, that shotcrete can be sprayed on it without tearing the burlap fabric or causing non-elastic sagging of the supporting wire mesh. Positioning of the horizontal and vertical rebar is easily accomplished without making measurements and without the need for complicated and precise attachment procedures such as welding and provides a great deal of structural support for the shotcrete as it is sprayed onto the structure. The great strength of the wire mesh and burlap panels and fabric, vertical rebar and horizontal rebar structure allows the use of fewer vertical arches and also allows omission of the horizontal I-beams that have been used in most of the known prior dome-like structures. Our structure is sufficiently strong that an entire four inch layer of shotcrete can be sprayed on the structure in one operation, avoiding the need of spraying thin layers successively, allowing each layer to dry before spraying the next one. The latter approach takes much more time and is much more expensive than our approach of providing a sufficiently strong structure to allow the entire four inches of shotcrete to be sprayed on in one operation.

Since the earth covered structures provide a great deal of insulation by virtue of the earthen material itself, no interior insulation is used. By providing suitable waterproofing of the outer shotcrete surface and avoiding the presence of air gaps within the wall structure, water condensation which can cause rusting of the steel framework and leakage of moisture through the shotcrete is avoided. Virtually, none of the shotcrete is wasted because none passes through the burlap fabric. This makes it possible to apply only a thin layer of plaster to the inner surface. The plaster adheres to the inner surface of the burlap fabric and also the wire mesh supporting the fabric, avoiding the need for a thick layer of plaster which is necessar to cover up protruding pieces of gunnite or shotcrete that are sprayed onto prior art wire mesh structures without fabric thereon.

In effect, what we have done is to replace a great deal of the heavy structural steel beams and difficult to make interconnections of prior art dome or barrel-shaped structures with a system that provides suhstantially more structural strength when it is most needed, i.e., when the wet shotcrete is being sprayed on, with a re-bar mesh-fabric structure which avoids the above-mentioned difficulties of the prior art structures, and furthermore, allows use of only a few types of prefabricated members to economically construct quite a large number of different shapes and sizes of buildings, either underground, partially above ground, or mostly above ground level.

While the invention has been described with reference to a particular embodiment thereof, those skilled in the art will be able to provide variations in the disclosed structure and method without departing from the true spirit and scope of the invention. For example, an above ground retaining wall can be built around the periphery of the "bermed up" portion of the dome to retain the earthen material covering the dome surface and to provide an attractive exterior appearance. An attractive above-ground garage may be built adjacent or contiguous to the dome or retaining wall. Other materials, such as synthetic fabrics, can be used instead of the fabric described.

The attached Preliminary Amendment is incorporated herein by reference, and has been read by the inventors and is encompassed by the attached Declaration.

We claim:

1. A method of constructing a substantially underground building, said method comprising the steps of:

(a) excavating an opening in the ground, said opening having a level bottom;

(b) pouring a quantity of cementitious material into a predetermined region of said hole to form a foundation;

(c) attaching a plurality of lower connecting elements to peripheral portions of said foundation;

(d) positioning an upper connecting member a predetermined height above a roughly central portion of said bottom;

(e) attaching the lower end of each of a plurality of arch members to a respective one of said lower connecting elements and connecting the upper end of each of said arch elements to a respective point of said upper connecting member so that said arch members are rigidly supported in a generally dome-like configuration over said bottom;

(f) supporting semi-rigid mesh on the outer surfaces of said arch members and supporting a layer of fabric on the outer surface of said mesh, said fabric being sufficiently closely interwoven to prevent appreciable amounts of cementitious material subsequently applied to said fabric from passing through said fabric prior to hardening;

(g) positioning a plurality of rigid reinforcing rods adjacent to the outer surface of said fabric, at least some of said reinforcing rods engaging and being supported by various ones of said arch members; and (h) applying a layer of plastic cementitious material to the outer surface of said fabric, said plastic cementitious material covering said reinforcing members, causing at least some of said reinforcing members to be embedded in said plastic cementitious material.

2. The method of claim 1 wherein step (c) includes the step of embedding a plurality of spaced substantially vertical tubes in the cementitious material of said foundation for receiving lower ends of a plurality of the reinforcing rods.

3. The method of claim 2 wherein said embedding step includes positioning of said substantially vertical tubes before said pouring of said cementitious material to form said foundation.

4. The method of claim 2 wherein said mesh includes a layer of stiff wire mesh and said fabric includes a sheet of burlap material.

5. The method of claim 4 wherein said reinforcing rods are rebar and step (g) includes the steps of:

positioning a first group of vertically spaced pieces of rebar horizontally between various ones of said arch members adjacent to the outer surface of said burlap material;

positioning a second group of horizontally spaced pieces of vertical rebar over said first group, the lower end of each of said pieces of vertical rebar being inserted into a respective one of said tubes; and positioning a third group of vertically spaced horizontal pieces of rebar on the outside of said second group.

6. The method of claim 5 including the step of utilizing pieces of tie wire to tie various ones of the pieces of rebar together and to said mesh at points where the pieces of rebar cross each other to support said mesh at said points, said method including bending the various pieces of rebar during said positioning of step 1 to cause the positioned pieces of rebar to have curvature corresponding to the curvature of said generally dome-like configuration.

7. The method of claim 1 further including the step of covering exposed portions of the cementitious material with earthen material after hardening of the cementitious material.

8. The method of claim 2 wherein the fabric of step (f) and the semi-rigid mesh of step (f) are precut and attached together to form composite mesh-fabric panels and wherein said composite mesh-fabric panels are positioned prior to step (g) and are attached to the inner side of the reinforcing rods after step (g).

9. The method of claim 1 wherein step (h) includes spraying shotcrete or gunnite at the outer surface of said fabric after step (g) to produce an entire reinforced cementitious wall of said building without waiting for inner portions of said sprayed on shotcrete or gunnite to dry before spraying on outer portions thereof, said method also including the step of applying water-proofing material to said reinforced cementitious wall.

10. The method of claim 1 including welding a plurality of bendable tabs on the outer surfaces of said arch members at location whereat said reinforcing rods are to be subsequently attached to said arch members, said method including the steps of bending said tabs outward, positioning horizontal ones of said pieces of reinforcing rod in engagement with said bent out tabs, and further bending said tabs around said horizontal pieces of reinforcing rods to securely attach them to said arch members.

11. The method of claim 1 wherein step (d) includes attaching additional members to said upper connecting member to lengthen said upper connecting member to thereby effect construction of a generally elongated building.

12. The method of claim 9 wherein said spraying of said shotcrete or gunnite produces a reinforced cementitious wall structure having a thickness of approximately four inches and composed of shotcrete or gunnite, reinforcing rod, fabric and mesh.

13. The method of claim 11 wherein said attaching of said lower connecting elements is done by means of bolts and said connecting of said upper ends of each of said arch elements to said upper connecting member is also done by means of bolts, wherein no welding is required in said attaching operation.

14. A method of constructing a building, said method comprising the steps of:

(a) pouring a quantity of cementitious material into a predetermined hole to form a foundation on a ground surface;

(b) attaching a plurality of lower connecting elements to peripheral portions of said foundation;

(c) positioning an upper connecting member a predetermined height above a roughly central portion of said ground surface;

(d) attaching the lower end of each of a plurality of arch members to a respective one of said lower connecting elements and connecting the upper end of each of said arch elements to a respective point of said upper connecting member so that said arch members are rigidly supported in a dome-like configuration over said ground surface;

(e) supporting semi-rigid mesh on the outer surfaces of said arch members and supporting a layer of fabric on the outer surface of said mesh, said fabric being sufficiently closely interwoven to prevent appreciable amounts of cementitious material subsequently applied to said fabric from passing through said fabric prior to hardening;

(f) positioning a plurality of rigid reinforcing rods adjacent to the outer surface of said fabric, at least some of said reinforcing rods engaging and being supported by various ones of said arch members; and (g) applying a layer of plastic cementitious material to the outer surface of said fabric, said plastic cementitious material covering said reinforcing members, causing at least some of said reinforcing members to be embedded in said plastic cementitious material.

15. A substantially underground structure comprising:

(a) a foundation disposed in a hole having a bottom substantially lower than the earth level generally surrounding said underground structure;

(b) a generally arched outer wall;

(c) a plurality of curved arch members for supporting said outer wall, each arch member having an upper end and a lower end;

(d) lower attaching means for rigidly attaching the lower ends of said arch members to peripheral portions of said floor slab;

(e) upper attaching means for rigid attachment to the upper ends of said arch members to hold said plurality of arch members in a dome-like configuration over said floor slab, said outer wall including (i) an inner layer of semi-rigid mesh, (ii) a layer of fabric supported by said mesh, said fabric being sufficiently closely interwoven to prevent appreciable amounts of cementitious material applied thereto from passing through said fabric prior to hardening of the cementitious material, (iii) a plurality of rebar rods disposed adjacent to the outer surface of said fabric, at least some of said rebar rods being attached to various ones of said arch members, (iv) connecting means for connecting a plurality of points of said mesh to various ones of said rebar rods to support said mesh and said fabric, (v) a layer of sprayed on solid cementitious material disposed on said fabric, said cementitious material covering said rebar rods and embedding a plurality of said rebar rods in said cementitious material; and (f) an atrium, said atrium having a substantially vertical wall, earthen material abutting a lower portion of the outer surface of said vertical wall, and upper portion of said vertical wall extending above the abutting earthen material to prevent entry of any of the abutting earthen material into said first atrium, said vertical wall adjoining said outer wall having a first opening therein for admitting outside light from said first atrium into the lower portion of said structure.

16. The substantially underground structure of claim 15 wherein a central portion thereof is partially barrel-shaped, a rear portion is partially dome-shaped, and a front wall thereof is substantially vertical, said atrium being located nearer to said rear portion than to said front wall.

17. A method of constructing a building, said method comprising the steps of:

(a) forming a foundation;

(b) attaching a plurality of lower connecting elements to peripheral portions of said foundation;

(c) positioning an upper connecting member a predetermined height above a roughly central portion of a floor area;

(d) attaching the lower end of each of a plurality of arch members to a respective one of said lower connecting elements and connecting the upper end of each of said arch elements to a respective point of said upper connecting member so that said arch members are rigidly supported in a generally dome-like configuration over said bottom;

(e) supporting semi-rigid mesh on the outer surfaces of said arch members and supporting a layer of fabric on the outer surface of said mesh, said fabric being sufficiently closely interwoven to prevent appreciable amounts of cementitious material subsequently applied to said fabric form passing through said fabric prior to hardening;

(f) positioning a plurality of rigid reinforcing rods adjacent to the outer surface of said fabric, at least some of said reinforcing rods engaging and being supported by various ones of said arch members; and (g) applying a layer of plastic cementitious material to the outer surface of said fabric, said plastic cementitious material covering said reinforcing members, causing at least some of said reinforcing members to be embedded in said plastic cementitious material.

* * * * *